US005402195A

United States Patent [19]

Glover et al.

[11] Patent Number: 5,402,195

[45] Date of Patent: Mar. 28, 1995

[54] PHOTOGRAPHIC PROCESSING APPARATUS

[75] Inventors: Edward C. T. S. Glover, London; Peter D. Marsden, Middlesex; Martyn S. Glover, Herts, all of United Kingdom

[73] Assignee: Eastman Kodak Company, Rochester, N.Y.

[21] Appl. No.: 74,828

[22] PCT Filed: Dec. 10, 1991

[86] PCT No.: PCT/EP91/02364

§ 371 Date: Jun. 11, 1993

§ 102(e) Date: Jun. 11, 1993

[87] PCT Pub. No.: WO92/10790

PCT Pub. Date: Jun. 25, 1992

[30] Foreign Application Priority Data

Dec. 13, 1990 [GB] United Kingdom ..... 9027061

[51] Int. Cl.[6] ..... G03D 3/08

[52] U.S. Cl. ..... 354/321

[58] Field of Search ..... 354/314–324

[56] References Cited

U.S. PATENT DOCUMENTS

| | | | |
|---|---|---|---|
| 3,183,690 | 5/1965 | Zimmerli | 354/328 |
| 3,192,846 | 7/1965 | Wright | 354/324 |
| 3,618,567 | 11/1971 | Levy | 118/637 |
| 3,640,101 | 2/1972 | Wilcox | 354/324 |
| 4,395,472 | 7/1983 | Robillard | 430/47 |

FOREIGN PATENT DOCUMENTS

| | | | |
|---|---|---|---|
| 3669 | 8/1979 | European Pat. Off. | 354/320 |
| 2038339 | 2/1972 | Germany . | |
| 2-129638 | 5/1990 | Japan | 354/324 |
| 2-129639 | 5/1990 | Japan | 354/324 |

*Primary Examiner*—D. Rutledge

*Attorney, Agent, or Firm*—Nixon, Hargrave, Devans & Doyle

[57] ABSTRACT

It is known to apply processing solution to photographic material using a high speed moving surface. High speed rotating drums have been used to transfer processing solution from a reservoir to the material. Horizontal belts are also known. However, such arrangements require large volumes of processing solution in order to operate effectively. Described herein is a processor comprising a vertically mounted high speed belt which both transfers processing solution from a reservoir onto photographic paper being processed, and provides agitation at the paper surface. Two transport belts are provided, one on either side of the belt to assist in the transport of paper through the apparatus. An arrangement according to the invention has the advantages that only low volumes of processing solutions are required, good surface agitation is provided, and it can be fitted into conventional photographic processing apparatus.

9 Claims, 1 Drawing Sheet

PHOTOGRAPHIC PROCESSING APPARATUS

FIELD OF THE INVENTION

This invention relates to photographic processing apparatus and is more particularly, although not exclusively, concerned with the application of photographic processing solutions to the material to be processed.

BACKGROUND OF THE INVENTION

Processing solutions have been applied to photographic materials using various methods. One method has been to use a high speed moving surface. It has been known to use high speed spinning drums to provide the high speed moving surface. In these arrangements, processing solution is retained in a tray through which the high speed moving surface passes. As the surface passes through the tray, it lifts processing solution out of the tray and carries it to a position where the solution is applied to the photographic material being processed.

In one arrangement where a high speed spinning drum is used, a mess blanket is used to hold the material against the drum surface. The drum is heated by hot water inside it. In another arrangement, a moving belt is used to transport the material across the surface of the spinning drum.

U.S. Pat. No. 3,192,846 discloses an arrangement in which photographic material is transported through processing apparatus on fluid layers formed one either side of the material. These fluid layers act as bearings for the material to prevent it becoming damaged during transportation. The fluid layers are applied by conduits positioned on either side of the material. The material is driven through the processing chamber by drive rollers positioned at either end. Another arrangement is also described in which rollers are used to guide material over a moving applicator belt as described above. Agitation is achieved when the linear speed of the applicator belt greatly exceeds the linear speed of the material being fed through the processing chamber.

In the applicator belt arrangements decribed above, large volumes of processing solution are required. This means that the processing solutions used need to be stable for relatively long periods of time.

In redox amplification processes where colour materials are developed to produce a silver image (which may contain only small amounts of silver) and then treated with a redox amplifying solution to form a dye image, the amplifying solution contains both an oxidising agent and a reducing agent and it is therefore inherently unstable. That is to say, unlike a conventional colour developer solution, amplifier solutions will deteriorate in less than an hour even if left in a sealed container. The best reproducibility for such a process has been obtained by using a "one shot" system, where the oxidant is added to the developer and the solution mixed and used immediately (or after a short built in delay) and then discarded. Such a "one shot" system cannot be used with the applicator belt arrangements described above as a relatively large volume of processing solution is required. Furthermore, the "one shot" system leads to the maximum solution usage possible with maximum effluent and maximum chemical costs. As a result the whole system is unattractive especially for a minilab environment where minimum effluent is required. It is believed that it is these shortcomings that have inhibited commercial use of this process.

It is therefore an object of the present invention to provide processing apparatus incorporating an applicator belt which uses small amounts of processing solution, and therefore overcomes the disadvantages mentioned above.

SUMMARY OF THE INVENTION

According to one aspect of the present invention, there is provided photographic processing apparatus for processing photographic material comprising an applicator belt for applying processing solution to the photographic material characterized in that at least one transport surface is provided for transporting the material over the surface of the applicator belt and in that the applicator belt lies in a substantially vertical plane.

Advantageously, a reservoir is provided for storing processing solution. The applicator belt removes solution from the reservoir for application to the photographic material as it moves through the reservoir. The reservoir has a volume such that replenishment rate of the processing solution is at 1east three times the reservoir volume during the useful life of the processing solution.

By this arrangement, only a small amount of processing solution is required. This has the advantage that unstable processing solutions, for example those used in redox amplification processing can be used.

It is preferred that the at least one transport surface comprises a surface of a transport belt which is positioned adjacent the applicator belt. In the preferred embodiment of the invention, two transport belts are provided which are positioned one on either side of the outside surface of the applicator belt. This has the further advantage in that apparatus according to the invention can easily be fitted into standard photographic processing apparatus.

BRIEF DESCRIPTION OF THE DRAWINGS

For a better understanding of the present invention, reference will now be made, by way of example only, to the accompanying drawing, the single FIGURE of which shows a schematic cross-sectional view of an applicator belt arrangement constructed in accordance with the invention.

DETAILED DESCRIPTION

Figure 1:
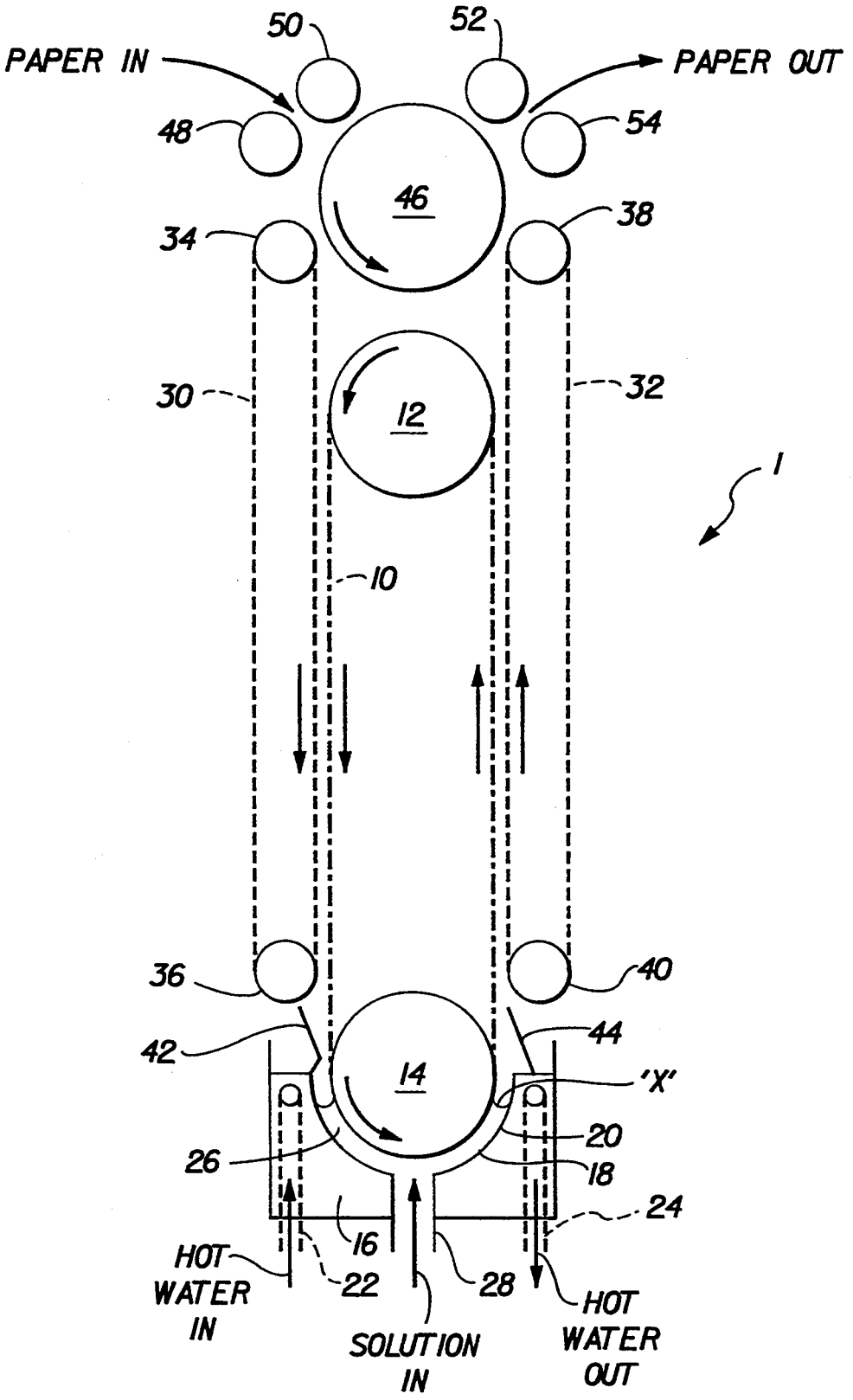

A processor constructed according to the present invention is illustrated in FIG. 1. The processor comprises a centrally mounted applicator belt 10 which is carried by a pair of rollers 12, 14. At the lower end of the belt 10, a hollow block 16 is positioned, the upper surface 18 of the block being shaped to define a reservoir 20.

The reservoir 20 is heated by hot water, the hot water flowing into and out of the block 16 at 22 and 24 respectively. Processing solution 26 is maintained at a predetermined level within the reservoir 20 as indicated by arrow 'X', and is added to and removed from the reservoir 20 by inlet/outlet 28.

The lower roller 14 dips into the reservoir 20 and processing solution 26 is picked up and carried round by the applicator belt 10.

A transport belt 30, 32 is mounted on each side of the applicator belt 10 as shown. Each belt 30, 32 is carried by a pair of vertically spaced rollers 34, 36, 38, 40. The lower rollers 36, 40 are positioned adjacent the reservoir 20. Guides 42, 44 are provided at the lower ends of the transport belts 30, 32 to direct the photographic paper to be processed into and out of the reservoir 20.

A central roller 46, positioned above the upper roller 12, helps to guide the paper into and out of the processor 1 in conjunction with inlet guide rollers 48, 50 and outlet guide rollers 52, 54.

In use, processing solution 26 is added to the reservoir 20 through the inlet/outlet 28. Photographic material, for example paper, is fed into the processor 1 through inlet rollers 48, 50. The paper is then directed, by roller 46 and transport belt 30 in to the space between the applicator belt 10 and transport belt 30 itself. The transport belt 30 holds the paper against the applicator belt 10 and drives it through the processor 1 in a downward direction until guide 42 is reached.

Here, the paper is directed into the processing solution 26 retained in the reservoir 20 by the guide 42. The surface 18 of the block 16 defining the reservoir 20 guides the paper through the processing solution 26 around roller 14 and that portion of the applicator belt 10 adjacent the roller at that instant towards guide 44. The paper is then directed upwards into the space between the applicator belt 10 and the other transport belt 32. The belt 32, like belt 30, holds the paper against the applicator belt 10 and drives it upwards away from the reservoir 20 towards the roller 46. Roller 46 directs the paper through outlet rollers 52, 54 to the next stage in the processing apparatus.

In the processor shown in the drawing, the paper being processed is retained on the transport belts 30, 32 by means of suction. This means that the paper is travelling at the same linear speed as the transport belts 30, 32. The applicator belt 10 has a much higher linear speed and carries a layer of processing solution on its outside surface.

The paper surface being processed is maintained in contact with the liquid layer, and agitation of the surface is provided by shear produced across this liquid layer due to the difference in linear speed between the applicator belt 10 and the transport belts 30, 32.

The transport belts 30, 32 have linear speeds of approximately 25 $mms^{-1}$, whilst the applicator belt 10 has a linear speed in the range of 0.15 to 1.02 $ms^{-1}$ (30 to 200 $ftmin^{-1}$).

As only a small volume of processing solution 26 is contained in the reservoir 20, the turnover of prescessing solution can be very short, for example less than 10 minutes. This means that equilibrium can be approached in 30 minutes, and in this example the solution stability of the unreplenished working developer gave acceptable sensitometry over a period of 30 minutes. The reservoir 20 retains a volume of processing solution between 100 and 150 ml prior to start up of the applicator belt 10. Naturally, as the belt 10 moves processing solution is removed from the reservoir 20 and applied to the material being processed.

As only low volumes of processing solution are used in the processor, only small volumes of solution need to be discarded if the processor is stopped for any reason, for example cleaning. This reduces the effluent produced.

It is preferred that the applicator belt 10 has a patterned surface to assist in the take-up of processing solution from the reservoir 20. The patterned surface also assists in the provision of agitation to the paper surface.

As the processor is arranged substantially vertically, it can easily be fitted into standard processing apparatus, for example, a Noritsu 801 or Kodak system 25 processor.

Although the invention has been described with reference to the processing of photographic paper, it is not limited to such use only.

Furthermore, the processor according to the present invention is not limited to use for processing material in a continuous web, but could equally well be used for sheets of material.

The processor according to the invention can be used in any environment where good agitation is required.

In the embodiment described, the emulsion surface of the paper is innermost. However, it may be desirable that the emulsion surface is outermost. In such a case, the two outer belts 30, 32 are now high speed applicator belts, and the inner belt 10 is a transport belt. Reservoir 20 is then replaced by a simple turnaround system comprising a single roller and two guide members which convey the paper from a position adjacent roller 36 to a position adjacent roller 40. Two reservoirs, each one mounted below a respective one of rollers 36, 40, are also provided to supply processing solution to each one of the two applicator belts. These reservoirs may be either entirely separate or fluidly connected to one another.

We claim:

1. Photographic processing apparatus for processing photographic material comprising an applicator belt carried by at least two rollers and said applicator belt applying processing solution to the photographic material characterized in that at least one transport surface is provided for transporting the material over the surface of the applicator belt and in that the applicator belt lies in a substantially vertical plane and a reservoir adapted to conform to and be spaced from a portion of one of said rollers of said applicator belt, said reservoir storing processing solution and said applicator belt removing solution from said reservoir for application to the photographic material.

2. Apparatus according to claim 1 wherein the reservoir has a volume such that replenishment rate of the processing solution is at least three times the reservoir volume during the useful life of the processing solution.

3. Apparatus according to claim 1 wherein the reservoir has a volume to material width ratio below 20 $mlcm^{-1}$.

4. Apparatus according to claim 1 wherein the reservoir has a volume to material width ratio of 10 $mlcm^{-1}$.

5. Apparatus according to claim 1, wherein the at least one transport surface is provided by a surface of a transport belt which is positioned adjacent the applicator belt.

6. Apparatus according to claim 5, wherein two transport belts are provided, and are positioned on either side of and adjacent the outer surface of the applicator belt.

7. Apparatus according to claim 5, further including a further applicator belt, each applicator belt being symmetrically arranged adjacent the outer surface of the transport belt.

8. Apparatus according to claim 1, wherein a fluid bearing is formed between the applicator belt and the material being processed.

9. Apparatus according to claim 1, wherein the photographic material is in sheet form.

* * * * *